US005747944A

United States Patent [19]

Harada

[11] Patent Number: 5,747,944

[45] Date of Patent: May 5, 1998

[54] FLASH DEVICE HAVING PLURAL EMISSION MODES IN ONE OF WHICH A FLASH INDUCTOR IS SELECTIVELY SHORT-CIRCUITED

[75] Inventor: Yoshihito Harada, Kanagawa-ken, Japan

[73] Assignee: Canon Kabushiki Kaisha

[21] Appl. No.: 566,149

[22] Filed: Dec. 1, 1995

[30] Foreign Application Priority Data

Dec. 7, 1994 [JP] Japan ..... 6-303868

[51] Int. Cl.[6] ..... H05B 37/02

[52] U.S. Cl. ..... 315/241 P; 354/415; 354/241 S

[58] Field of Search ..... 315/241 P, 241 S; 354/41 J

[56] References Cited

U.S. PATENT DOCUMENTS 4,881,013 11/1989 Kataoka et al. ..... 315/241 P

*Primary Examiner*—Robert Pascal
*Assistant Examiner*—Michael Shingleton
*Attorney, Agent, or Firm*—Robin, Blecker, Daley and Driscoll

[57] ABSTRACT

In a flash device of the kind having a coil connected to a flash lamp and arrange to bring about a flat emission by the action of the coil, a switching circuit is arranged to short-circuit the coil after flashing emission is started, so that a good flash terminating characteristic for normal flashing emission can be obtained.

28 Claims, 3 Drawing Sheets

FLASH DEVICE HAVING PLURAL EMISSION MODES IN ONE OF WHICH A FLASH INDUCTOR IS SELECTIVELY SHORT-CIRCUITED

BACKGROUND OF THE INVENTION

Field of the Invention

This invention relates to a flash device to be used along with an optical apparatus such as a camera, and more particularly to a device which is capable of making flat emission of a flash light as well as instantaneous flash emission.

Description of the Related Art

Conventional flash devices have been configured as shown in outline in FIGS. 2 and 3.

FIG. 3 shows a first example of the conventional flash device.

Referring to FIG. 3, reference numeral 1 denotes a battery. A step-up circuit 2 which is a DC-to-DC converter or the like is arranged to boost the output voltage of the battery 1. A flash lamp 3 is a xenon discharge lamp or the like. A main capacitor 4 is arranged to impart flashing energy to the flash lamp 3. A thyristor 5 is arranged to start and stop the flashing action of the flash lamp 3. A trigger circuit 6 is arranged to trigger flashing by the flash lamp 3. A limiting coil (hereinafter referred to as a choke coil) 7 is arranged to lessen the rise (di/dt) of a current obtained at the start of flashing by the flash lamp 3. A diode 8 for feedback is inverse-parallel connected to the choke coil 7 for the purpose of recovering, into the main capacitor 4, the electric charge of an induced current generated at the choke coil 7 immediately after the end of flashing by the flash lamp 3. A commutation circuit 9 is provided for turning off the thyristor 5. A light adjusting circuit 10 is arranged to measure a reflection light of a flash light projected onto an object of shooting and to drive the commutation circuit 9 according to the result of the light measurement. A microcomputer 11 is arranged to control the step-up circuit 2, the trigger circuit 6, etc.

The trigger circuit 6 includes a triggering pulse transformer, a triggering capacitor and a thyristor, etc. The commutation circuit 9 includes a commutating thyristor, a commutating capacitor, etc. Since these circuits are arranged in a known manner, the details of them are omitted from the illustration.

Although the operation of the flash device described above is well known, it is briefly described as follows. When the step-up circuit 2 is driven according to an instruction given from an output port P1 of the microcomputer 11, the output voltage of the battery 1 is boosted and a high voltage is thus generated by the step-up circuit 2. As a result, the main capacitor 4 is first charged to have a polarity shown in the drawing. After completion of charging the main capacitor 4, a high DC voltage is applied via the choke coil 7 to the anode of the flash lamp 3 to make the flash lamp 3 ready to flash. Then, a gate driving signal is applied from a port P2 of the microcomputer 11 to the gate of a thyristor (not shown) of the trigger circuit 6, so that the thyristor is turned on. Further, an electric charge stored in a triggering capacitor (not shown) is discharged to cause a high voltage pulse to be generated at the secondary side winding of a pulse transformer (not shown) which is wound around the flash lamp 3. The flash lamp 3 is then triggered to begin discharging. At the same time, a gate driving pulse generated at the trigger circuit 6 causes the thyristor 5 to turn on. With the thyristor 5 turned on, a current flows from the anode to the cathode of the flash lamp 3, and also flows through the thyristor 5 to a grounding line. Then, the flash lamp 3 emits a flash light, which is projected toward an object of shooting. A reflection light which is obtained with the flash light reflected by the object comes to fall on a light adjusting photodiode (not shown) which is included in the light adjusting circuit 10. The light is measured on the basis of an integrated value of a current generated by the light adjusting diode as a result of the incidence of the reflection light. Then, when a flashing stop signal from the light adjusting circuit 10 is applied to the gate of a commutating thyristor (not shown) disposed within the commutation circuit 9 according to the result of light measurement, the commutating thyristor is turned on, and an electric charge stored in a commutating capacitor (not shown) is discharged. With the electric charge thus discharged, an inverse bias is applied to the anode of the thyristor 5. Then, the thyristor 5 is turned off, and the current generated from the flash lamp 3 is cut off by the thyristor 5. After the thyristor 5 is turned off, the choke coil 7 is caused by electromagnetic induction to generate an electromotive force in the direction of preventing the current from decreasing. Therefore, an induced current is generated on the output end side of the choke coil 7. However, when flashing comes to a stop within the flash lamp 3, the induced current is fed back through the diode 8 to charge the positive electrode of the main capacitor 4. The electromagnetic energy thus recovered in the main capacitor 4 is used for next flashing.

FIG. 2 shows in outline a second example of the conventional flash device. In FIG. 2, the same component elements as those of FIG. 3 are indicated by the same reference numerals as in FIG. 3 and are omitted from description. In the case of FIG. 2, an insulated gate bipolar transistor (hereinafter abbreviated to IGBT) 14 is used, in place of the thyristor, as an element for starting and stopping the flash light emission by the flash lamp 3. A gate driving circuit 15 which drives the gate of the IGBT 14 is used in place of the commutation circuit 9 of FIG. 3. A choke coil 12 is connected between the anode of the flash lamp 3 and each of the main capacitor 4 and the output terminal of the step-up circuit 2. This choke coil 12 has a larger inductance, i.e., a larger storing energy, than the choke coil 7 of FIG. 3. In the case of FIG. 2, an energy feedback route is arranged to connect the input terminal of the choke coil 12 to the cathode of the flash lamp 3. A diode 13 is provided in the energy feedback route.

The second example of the conventional flash device has the following features: (i) The choke coil 12 is used for causing the flashing current of the flash lamp 3 to moderately rise (di/dt) and fall to make flashing as flat as possible and also to make the effective flashing time as long as possible, and (ii) The use of the IGBT 14 as a current controlling element for controlling the current of the flash lamp 3 not only makes it possible to perform switching at a higher speed than the thyristor 5 but also dispenses with a commutation circuit to permit reduction in size of the device, because the gate driving circuit 15 for the IGBT 14 is smaller than the commutation circuit 9 for the thyristor 5.

The device of FIG. 2 operates in almost the same manner as the device shown in FIG. 3. However, the operation of the device of FIG. 2 is briefly described as follows. When the step-up circuit 2 is driven by a signal from a port P1 of the microcomputer 11, the main capacitor 4 is charged with a high voltage outputted from the step-up circuit 2. After that, a high voltage direct current is applied to the anode of the flash lamp 3 via the choke coil 12. Then, the trigger circuit 6 is driven by a signal from an output port P2 of the microcomputer 11. A trigger pulse is generated at the secondary winding of a triggering transformer (not shown) which is disposed within the trigger circuit 6. The trigger pulse causes discharge to take place within the flash lamp 3. At the same time, the gate driving circuit 15 is driven by a signal supplied from an output port P3 of the microcomputer 11. The gate driving circuit 15 then applies a gate driving pulse to the gate of the IGBT 14 to turn on the IGBT 14. As a result, a current flowing from the anode to the cathode of the flash lamp 3 comes to flow to the grounding line through the IGBT 14. An object of shooting is then illuminated by a flash light emitted from the flash lamp 3. At this time, since the collector voltage of the IGBT 14 is lower than the cathode voltage of the diode 13, the current flowing the flash lamp 3 does not flow into the diode 13.

The flash light which is illuminated onto and reflected by the object comes to fall on a photodiode (not shown) included in the light adjusting circuit 10. When an integrated value of a current generated by the photodiode reaches a predetermined value, a signal from the light adjusting circuit 10 comes into an input port P4 of the microcomputer 11. The microcomputer 11 then changes the output level of the port P3 from a high level to a low level. This change causes the gate driving circuit 15 to apply an off signal to the gate of the IGBT 14. The IGBT 14 is turned off by this off signal. As a result, the flashing current of the flash lamp 3 is cut off by the IGBT 14. However, as the flashing current of the flash lamp 3 attenuates, an induced current is generated at the choke coil 12 by electromagnetic induction. Therefore, a current flows from the choke coil 12 to the flash lamp 3 for a very short period of time after the turning-off of the IGBT 14. This current is fed back toward the input terminal of the choke coil 12 from the cathode of the flash lamp 3 through the diode 13 to be recovered at the main capacitor 4 as flashing energy for next flashing.

Since the flash device which is arranged in the manner described above is intended to be used along with a camera, it is necessary that the flashing time of the flash light is synchronized with the operation of the shutter mechanism of the camera. This synchronization, which is generally called "synchro-flash", is an important matter particularly for a camera of the kind having a focal plane shutter.

A method for synchronizing the flashing by the flash device with the shutter operation of the camera having a focal plane shutter, such as a single-lens reflex camera, has been well known. The method is called the leading curtain synchro-flash method. According to this method, while a shutter opening action is in process, a flash device synchronizing contact which is called an X contact is turned on to cause the flash device to flash at a point of time immediately after the end of travel of the leading curtain of the shutter, i.e., at a point of time when an aperture is fully opened. However, such a flash device synchronizing action is possible only for shutter speeds up to 1/250 or 1/300 sec. If the shutter speed is higher than the limit speed, a tailing curtain of the shutter begins to travel before the travel of the leading curtain across an aperture comes to an end, so that the aperture is never fully opened. Under such a condition, an exposure action on a film surface is made only through a slit formed between the rear end of the leading curtain and the front end of the trailing curtain and thus results in a so-called slit exposure. In order to make an exposure with the flash illumination through the whole aperture, it is necessary to continuously emit the flash light almost at a constant intensity until the slit passes the whole area of the aperture. This mode of flashing is called "flat emission". The aperture traveling time of the above-stated slit is 1/30 to 1/60 sec. The effective flashing time of a xenon discharge lamp (flash lamp), on the other hand, is 1/1000 sec., or thereabout. Therefore, it is impossible to uniformly make the flash illumination for a whole picture plane. Synchronizing a flash light is thus hardly possible at a high shutter speed above 1/250 to 1/300 sec. In the case of flash photography at such a high shutter speed, therefore, it is impossible to make a uniform illumination for the whole picture plane. However, on some occasion, a picture must be taken with the aid of flashing by a flash device even at a high shutter speed at which flashing cannot be synchronized. In view of this, the intensity of flashing by the flash device is preferably as close as that of the flat emission for such a high shutter speed as well as for photographing at a shutter speed at which flashing can be synchronized with the shutter.

Hence, in the case of FIG. 2, the conventional flash device is arranged to moderate the inclination of the rise of the flash starting current (di/dt) by inserting the choke coil 12 of a relatively large inductance in between the anode of the flash lamp 3 and the step-up circuit 2. At the fall of the current, the induced current generated at the choke coil 12 is allowed to flow through the flash lamp 3 to make the flashing time longer. Both the rise and fall of the current flowing through the flash lamp 3 can be moderated and the flashing intensity can be flattened (uniformalized) by such an arrangement. Further, another advantage of the arrangement lies in that, since the switching speed of the IGBT 14 does not have to be much increased, the possibility of causing the IGBT 14 to be destroyed or out of order can be lessened.

SUMMARY OF THE INVENTION

It is one aspect of the invention under this application to provide a flash device or a flash photography system of the kind having a coil provided between a flashing energy storing main capacitor and a flash lamp so as to attain the above-stated flat emission by the action of the coil, wherein a switching element is arranged to short-circuit the coil and the switching element is operated in a normal flashing mode, etc., so that a problem of an inadequate flash terminating characteristic which tends to arise in the normal flashing mode in a flash device of the above-stated kind arranged to be capable of making the flat emission can be solved by virtue of the action of the switching element.

The above and other aspects or objects and features of the invention will become apparent from the following detailed description of an embodiment thereof taken in conjunction with the accompanying drawings.

DETAILED DESCRIPTION OF THE PREFERRED EMBODIMENT

An embodiment of the invention is described below with reference to FIG. 1.

Figure 1:
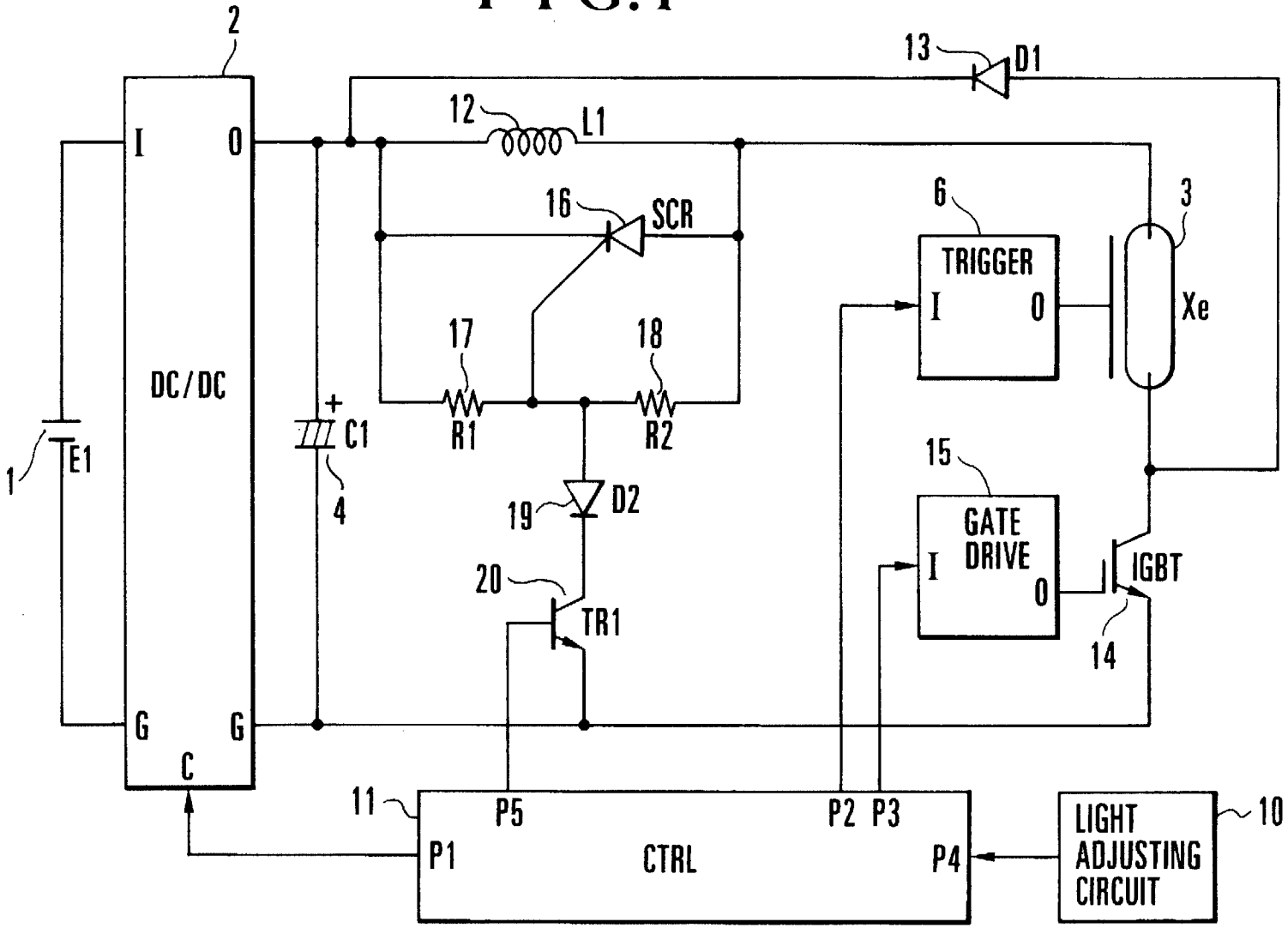
FIG. 1 is a block diagram showing in outline the arrangement of a flash device according to the invention as an embodiment thereof.
Figure 2:
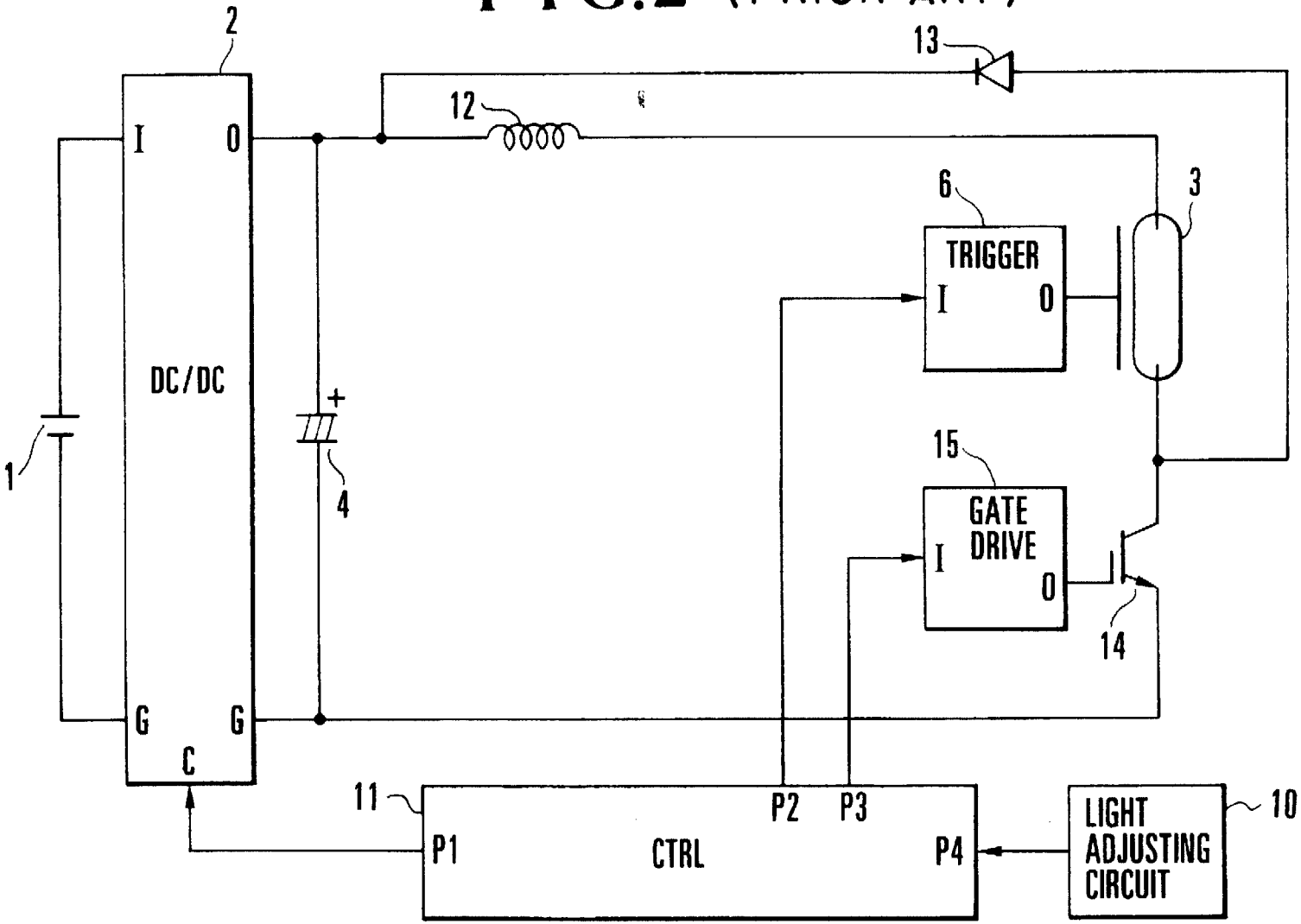
FIG.2 (PRIOR ART)
FIG. 2 is a block diagram showing in outline the arrangement of a second example of a conventional flash device.
Figure 3:
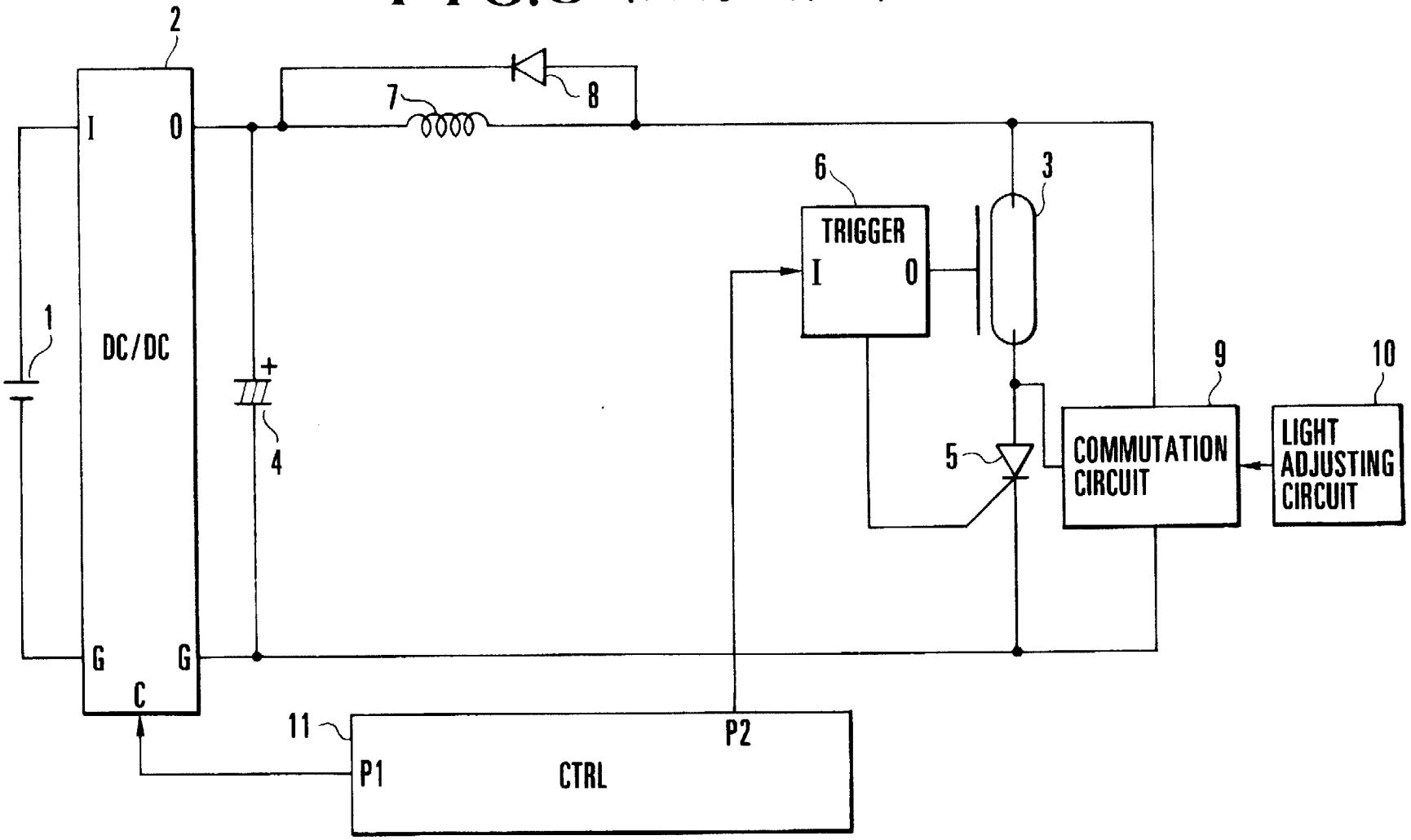
FIG. 3 (PRIOR ART)
FIG. 3 is a block diagram showing in outline the arrangement of a first example of a conventional flash device.

In FIG. 1, component elements denoted by the same reference numerals as in FIG. 1 are identical with those shown in FIG. 2 and, therefore, the details of them are omitted from the following description.

In FIG. 1, reference numeral 1 denotes a battery. A step-up circuit 2 is composed of a DC-to-DC converter, etc. A flash lamp 3 is a xenon discharge lamp or the like. A main capacitor 4 is arranged to supply flashing energy to the flash lamp 3. A trigger circuit 6 is arranged to trigger the flash lamp 3. Reference numeral 11 denotes a microcomputer. A choke coil 12 (an inductance element) is arranged to moderate the inclination of the rise (di/dt) and the fall of a flashing current of the flash lamp 3. A diode 13 is disposed in a first discharge path which connects the cathode of the flash lamp 3 to the input terminal of the choke coil 12. An IGBT 14 serving as a switching element is arranged to control the on/off of the current for the flash lamp 3. A gate driving circuit 15 is arranged to apply a driving signal to the gate of the IGBT 14. A thyristor 16 for feedback is arranged to be inverse-parallel connected to the choke coil 12 in a second discharge path which connects the input and output terminals of the choke coil 12 to each other. Voltage dividing resistors 17 and 18 are connected in parallel to the thyristor 16 and are provided for driving the gate of the thyristor 16. A diode 19 has its anode connected to the gate of the thyristor 16 at a node between the resistors 17 and 18. An NPN transistor 20 has its collector connected to the cathode of the diode 19 and its emitter grounded. A light adjusting circuit 10 is arranged in a known manner to detect the luminance value of an object of shooting obtained when the object is illuminated by a flash light. The transistor 20 and the diode 19 form a gate driving circuit for driving the gate of the thyristor 16. A driving signal for the base of the transistor 20 comes from an output port P5 of the microcomputer 11.

In the flash device arranged as described above, the thyristor 16 remains in an off-state before flashing is performed. In other words, before flashing is performed, the gate potential of the thyristor 16 is low, the transistor 20 is in an on-state, and the driving signal applied from the output port P5 of the microcomputer 11 to the base of the transistor 20 is at a high level.

When the flash device becomes ready for flashing, the step-up circuit 2 is caused to generate a high DC voltage by a signal applied from an output port P1 of the microcomputer to the step-up-circuit 2. Then, the main capacitor 4 is charged with the high DC voltage. After that, a high DC current flows through the choke coil 12 to the anode of the flash lamp 3. A flashing mode selected by the camera user is stored in the microcomputer 11. The flash device operates according to the flashing mode selected as follows:

(a) When a flat emission mode is selected, a

A trigger signal is supplied from a port P2 of the microcomputer 11 to the trigger circuit 6 to cause the trigger circuit 6 to generate a flash lamp trigger signal. At the same time, a gate signal is supplied from a port P3 of the microcomputer 11 to the gate driving circuit 15 to cause the gate driving circuit 15 to generate a gate driving signal for turning on the gate of the IGBT 14. As a result, a discharge action begins within the flash lamp 3. Further, since the IGBT 14 is turned on, a current flows between the anode and the cathode of the flash lamp 3 to perform flashing. The current then flows from the emitter of the IGBT 14 to a grounding line. When the output of the light adjusting circuit 10 reaches a value which corresponds to a predetermined degree of luminance, a signal is supplied from the light adjusting circuit 10 to a port P4 of the microcomputer 11. The microcomputer 11 then turns off the signal applied to the gate driving circuit 15. The IGBT 14 is then turned off through the gate driving circuit 15. By this, the flow of the flashing current of the flash lamp 3 to the IGBT 14 is cut off. However, as the current flowing through the flash lamp 3 decreases after the IGBT 14 is turned off, an electromotive force is generated at the choke coil 12 in the direction of preventing the current from decreasing. As a result, an induced current caused by the electromotive force comes to flow from the choke coil 12 to the flash lamp 3. The inflow of this induced current allows flashing by the flash lamp 3 to further continue without coming to a stop. Then, the current which flows out from the cathode of the flash lamp 3 is fed back to the input terminal of the choke coil 12 through the diode 13 disposed in the first discharge path. The positive electrode of the main capacitor 4, which is in a state after the process of discharge, is charged by this current flow. Then, when the IGBT 14 is again turned on while flashing continues after the IGBT 14 is turned off, the electric charge thus obtained at the main capacitor 4 comes via the choke coil 12 to cause the flash lamp 3 to resume its flashing. When the output of the light adjusting circuit 10 obtained by the resumed flashing reaches a predetermined value, the IGBT 14 is again turned off. After that, the IGBT 14 is repeatedly turned on and off. The flat emission mode thus can be carried on for a long period of time. After the flat emission is repeatedly carried on for a predetermined period of time, when the IGBT 14 is turned off continuously, discharge from the choke coil 12 comes to a stop and the flash lamp 3 ceases to flash.

(b) When an instantaneous flash emission mode is selected, a

A trigger signal is supplied from the port P2 to the trigger circuit 6 to cause the trigger circuit 6 to generate a flash lamp trigger signal. At the same time, a gate signal is supplied from the port P3 to the gate driving circuit 15 to cause the gate driving circuit 15 to generate a gate driving signal for turning on the gate of the IGBT 14. As a result, a discharge action begins within the flash lamp 3. Further, since the IGBT 14 is turned on, a current flows between the anode and the cathode of the flash lamp 3 to cause flashing. The current then flows from the emitter of the IGBT 14 to the grounding line. When the output of the light adjusting circuit 10 reaches a value which corresponds to a predetermined degree of luminance, a signal is supplied from the light adjusting circuit 10 to the port P4 of the microcomputer 11. The microcomputer 11 then turns off the signal applied to the gate driving circuit 15. The IGBT 14 is then turned off through the gate driving circuit 15. By this, the flow of the flashing current of the flash lamp 3 to the IGBT 14 is cut off.

Meanwhile, the microcomputer 11 turns off the transistor 20 by inverting the level of the signal outputted from the port P5 from a high level to a low level at the same time or before the IGBT 14 turns off, or before flashing is started. Therefore, if the voltage on the output side of the choke coil 12 becomes higher than the voltage of the input side thereof, the anode voltage of the diode 19 rises to turn on the thyristor 16 with a positive driving pulse applied to the gate of the thyristor 16. At this time, the voltage for driving the gate of the thyristor 16 is at a value obtained by dividing a voltage between the terminals of the choke coil 12 by the resistors 17 and 18.

As the current of the flash lamp 3 decreases after the IGBT 14 is turned off, an electromotive force is generated at the choke coil 12 in the direction of preventing the decrease of the current. Due to the electromotive force, an induced current is generated at the choke coil 12. However, with the thyristor 16 turned on, the current which flows out from the output terminal of the choke coil 12 flows into the thyristor 16 and not into the flash lamp 3. The current is then fed back toward the input terminal of the choke coil 12, so that the main capacitor 4 is charged by the current. Therefore, the flash lamp 3 stops from flashing immediately after the IGBT 14 turns off, so that the flashing action can be carried out in the instantaneous flash emission mode to effectively prevent the object from being excessively illuminated.

While the embodiment described above is arranged to use the thyristor 16 for switching between the first discharge path and the second discharge path, the thyristor of course may be replaced with some other switching element. Further, in accordance with the invention, the method for setting the discharge paths is not limited to the arrangement of the embodiment described.

The thyristor 16 may be arranged to turn on immediately after flashing. Further, the microcomputer 11 of the embodiment may be disposed either within the flash device or on the side of the camera in the event of a system arranged to use the flash device by connecting it to the camera.

What is claimed is:

1. A flash device having a capacitor arranged to store flashing energy, an inductance element and a flash tube arranged to discharge, through the inductance element an electric charge stored in said capacitor, said flash device having a first emission mode and second emission mode, a) a path circuit connected in parallel to the inductance element and arranged to connect said capacitor and said flash tube to each other, after the electric charge starts to be discharged through said inductance element; and b) a switching circuit arranged to inhibit said path circuit from being formed in said first emission mode and to allow said path circuit to be formed in said second emission mode.

2. A device according to claim 1, wherein said first emission mode is a flat emission mode and said second emission mode is a normal emission mode.

3. A device according to claim 1, wherein said inductance element is a coil.

4. A flash device having a capacitor arranged to store flashing energy, an inductance element and a flash tube arranged to discharge, through the inductance element, an electric charge stored in said capacitor, comprising:

a) a switching element arranged to form an electric current path disposed in parallel to said inductance element; and b) a selection circuit arranged to selectively allow said switching element to act, in accordance with a flash emission mode.

5. A device according to claim 4, wherein, when being allowed to act by said selection circuit, said switching element is arranged to act after the electric charge is discharged through said inductance element.

6. A device according to claim 4, wherein, when being allowed to act by said selection circuit, said switching element is arranged to act when a flashing action comes to a stop after the electric charge is discharged through said inductance element.

7. A device according to claim 4, wherein said inductance element is a coil.

8. A device according to claim 4, wherein said selection circuit is arranged to inhibit said switching element from acting in a flat emission mode.

9. A flash device having a capacitor arranged to store flashing energy, an inductance element and a flash tube arranged to discharge, through the inductance element, an electric charge stored in said capacitor, comprising:

a) a first discharge path disposed between a terminal of said flash tube located opposite to a terminal thereof connected to said inductance element and a connection point of said capacitor to said inductance element;

b) a second discharge path disposed in parallel to said inductance element; and c) a selection circuit arranged to select the second discharge path in accordance with a flash photography mode.

10. A device according to claim 9, wherein said selection circuit is arranged to inhibit the second discharge path from being selected when being in a flat emission mode.

11. A device according to claim 10, wherein said selection circuit selects the second discharge path in an ordinary emission mode.

12. A flash device having a capacitor arranged to store flashing energy, an inductance element and a flash tube arranged to discharge, through the inductance element, an electric charge stored in said capacitor, comprising:

a) a discharge path disposed between a terminal of said flash tube located opposite to a terminal thereof connected to said inductance element and a connection point of said capacitor to said inductance element;

b) a switching element disposed in parallel to said inductance element; and c) a selection circuit for controlling a state of the switching element in accordance with a flash photography mode.

13. A device according to claim 12, wherein said selection circuit prohibits the turning on of the switching element in a flat emission mode.

14. A device according to claim 12, wherein said selection circuit permits the turning on of the switching element in an ordinary emission mode.

15. A flash photography system including a flash device having a capacitor arranged to store flashing energy, an inductance element and a flash tube arranged to discharge, through the inductance element, an electric charge stored in said capacitor, said flash device having a first emission mode and a second emission mode, comprising:

a) a path circuit connected in parallel to the inductance element and arranged to connect said capacitor and said flash tube to each other, after the electric charge starts to be discharged through said inductance element; and b) a switching circuit arranged to inhibit said path circuit from being formed in said first emission mode and to allow said path circuit to be formed in said second emission mode.

16. A system according to claim 15, wherein said first emission mode is a flat emission mode and said second emission mode is a normal emission mode.

17. A system according to claim 15, wherein said inductance element is a coil.

18. A flash photography system including a flash device having a capacitor arranged to store flashing energy, an inductance element and a flash tube arranged to discharge, through the inductance element, an electric charge stored in said capacitor, comprising:

a) a switching element arranged to form an electric current path disposed in parallel to said inductance element; and b) a selection circuit arranged to selectively allow said switching element to act, in accordance with a flash emission mode.

19. A system according to claim 18, wherein, when being allowed to act by said selection circuit, said switching element is arranged to act after the electric charge is discharged through said inductance element.

20. A system according to claim 18, wherein, when being allowed to act by said selection circuit, said switching element is arranged to act when a flashing action comes to a stop after the electric charge is discharged through said inductance element.

21. A system according to claim 18, wherein said inductance element is a coil.

22. A system according to claim 18, wherein said selection circuit is arranged to inhibit said switching element from acting in a flat emission mode.

23. A flash photography system including a flash device having a capacitor arranged to store flashing energy, an inductance element and a flash tube arranged to discharge, through the inductance element, an electric charge stored in said capacitor, comprising:

a) a first discharge path disposed between a terminal of said flash tube located opposite to a terminal thereof connected to said inductance element and a connection point of said capacitor to said inductance element;

b) a second discharge path disposed in parallel to said inductance element; and c) a selection circuit arranged to select the second discharge path in accordance with a flash photography mode.

24. A system according to claim 23, wherein said selection circuit is arranged to inhibit the second discharge path from being selected when being in a flat emission mode.

25. A system according to claim 23, wherein said selection circuit selects the second discharge path in an ordinary emission mode.

26. A flash photography system including a flash device having a capacitor arranged to store flashing energy, an inductance element and a flash tube arranged to discharge, through the inductance element, an electric charge stored in said capacitor, comprising:

a) a switching element arranged to form an electric current path disposed in parallel to said inductance element; and b) a selection circuit for controlling a state of the switching element in accordance with a flash photography mode.

27. A device according to claim 26, wherein said selection circuit prohibits the turning on of the switching element in a flat photography mode.

28. A device according to claim 26, wherein said selection circuit permits the turning on of the switching element in an ordinary emission mode.

* * * * *

UNITED STATES PATENT AND TRADEMARK OFFICE

CERTIFICATE OF CORRECTION

PATENT NO. : 5,747,944

DATED : May 5, 1998

INVENTOR(S) : Yoshihito Harada

It is certified that error appears in the above-identified patent and that said Letters Patent is hereby corrected as shown below:

Col. 5, line 47, delete ":" and insert – . –.

Col. 5, line 49, delete "A".

Col. 6, line 28, delete "A".

Signed and Sealed this

First Day of December, 1998

*Attest:*

*Attesting Officer*

BRUCE LEHMAN

*Commissioner of Patents and Trademarks*